US007871281B2

(12) United States Patent
Hemmi et al.

(10) Patent No.: US 7,871,281 B2
(45) Date of Patent: Jan. 18, 2011

(54) CONNECTOR

(75) Inventors: Yoshinobu Hemmi, Kyoto (JP); Hirotada Teranishi, Kyoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 12/445,020

(22) PCT Filed: Oct. 19, 2007

(86) PCT No.: PCT/JP2007/070433

§ 371 (c)(1),
(2), (4) Date: Apr. 9, 2009

(87) PCT Pub. No.: WO2008/050680

PCT Pub. Date: May 2, 2008

(65) Prior Publication Data

US 2010/0087078 A1 Apr. 8, 2010

(30) Foreign Application Priority Data

Oct. 23, 2006 (JP) ..... 2006-287661

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS

2006/0089036 A1* 4/2006 Takai et al. ..... 439/260

FOREIGN PATENT DOCUMENTS

| | | | |
|---|---|---|---|
| JP | 2004-178959 | A | 6/2004 |
| JP | 2004-221067 | A | 8/2004 |
| JP | 2004-342426 | A | 12/2004 |
| JP | 2006-120481 | A | 5/2006 |
| JP | 2006-210050 | A | 8/2006 |
| JP | 2006-210051 | A | 8/2006 |

OTHER PUBLICATIONS

International Search Report w/translation from PCT/JP2007/070433 dated Nov. 13, 2007 (4 pages).

* cited by examiner

*Primary Examiner*—Ross N Gushi

(57) ABSTRACT

A connector has a base having an opening to be inserted with a tip portion of a flexible printed circuit board at a front surface, and having a first insertion hole and a second insertion hole alternately juxtaposed at a predetermined pitch at the front surface and a rear surface, respectively, a first connection terminal to be inserted to the first insertion hole from a side, and having a first movable contact that comes into pressure contact with a first joint juxtaposed at a lower surface of the tip portion of the flexible printed circuit board, a second connection terminal to be inserted to the second insertion hole from a side, and having a second movable contact that comes into pressure contact with a second joint juxtaposed at an upper surface of the tip portion of the flexible printed circuit board, and an operating lever turnably supported by a pair of elastic arms extending in parallel from both side surfaces of the base, and having a first operating portion and a second operating portion for operating the first connection terminal and the second connection terminal, respectively, alternately juxtaposed at an edge on one side.

17 Claims, 14 Drawing Sheets

CONNECTOR

TECHNICAL FIELD

The present invention relates to connectors, and in particular, to a connector to connect to joints juxtaposed on upper and lower surfaces of a tip portion of a flexible printed circuit board (hereinafter referred to as "FPC").

BACKGROUND ART

Conventionally, a connector in which contacting portions 30, 30 of contacts 14, 16 contact contacting portions 52, 52 arranged in a staggered manner on an upper surface of an FPC 22 to connect the FPC 22 has been known, as described in Patent Document 1.

Patent Document 1: Japanese Unexamined Patent Publication No. 2004-221067

DISCLOSURE OF THE INVENTION

Problems to be Solved by the Invention

However, in the above-described connector, the contacting portion 52 is merely arranged on the upper surface of the tip portion of the FPC 22, and thus there is a limit to enhancing mounting density and miniaturizing a device is not easy. Furthermore, the connector easily comes off when pulled around, and the contact reliability is low.

In view of the above problems, it is an object of the present invention to provide a hard-to-come-off connector which can be miniaturized easily while exhibiting high mounting density and high contact reliability.

Means for Solving the Problem

In order to solve the above problems, a connector according to the present invention includes a base having an opening to be inserted with a tip portion of a flexible printed circuit board at a front surface, and having a first insertion hole and a second insertion hole alternately juxtaposed at a predetermined pitch at the front surface and a rear surface, respectively; a first connection terminal to be inserted to the first insertion hole from a side and having a first movable contact that comes into pressure contact with a first joint juxtaposed at a lower surface of the tip portion of the flexible printed circuit board; a second connection terminal to be inserted to the second insertion hole from a side and having a second movable contact that comes into pressure contact with a second joint juxtaposed at an upper surface of the tip portion of the flexible printed circuit board; and an operating lever turnably supported by a pair of elastic arms extending in parallel from both side surfaces of the base, and having a first operating portion and a second operating portion for operating the first connection terminal and the second connection terminal, respectively, alternately juxtaposed at an edge on one side.

EFFECT OF THE INVENTION

According to the present invention, connection can be made to the first and second joints juxtaposed on the upper and lower surfaces of the tip portion of the FPC. Thus, the first and second joints can be arranged at a mounting density higher than the related art, and the connector can be miniaturized.

When the FPC is connected to the connector according to the present invention, the tip portion of the FPC on which the first and second joints are juxtaposed has a wave-like shape at least in a width direction. Thus, a connector from which the FPC is less likely to come off, has strong resistance to being pulled around, and has high contact reliability is obtained.

In an embodiment according to the present invention, the first insertion hole and the second insertion hole may be alternately shifted in an up and down direction to be arranged in a staggered manner.

According to such an embodiment, the mounting density of the first and second connection terminals becomes higher, and miniaturization can be achieved.

In another embodiment according to the present invention, movable contacts adjacent on the same plane may be alternately shifted in an inserting direction to be arranged in a staggered manner.

According to such an embodiment, the positions where the movable contact contacts are in a staggered manner not only at the upper and lower surfaces but also in the same plane, and thus the mounting density further increases.

In still another embodiment according to the present invention, a pressure-contact tongue piece that is positioned immediately below the second movable contact of the second connection terminal and that comes into pressure contact with a lower surface of the second joint of the flexible printed circuit board may be arranged in a projecting manner at the first connection terminal.

According to such an embodiment, the second movable contact of the second connection terminal pushes the second joint of the FPC so that the lower surface of the second joint of the FPC pressure contacts the pressure-contact tongue piece of the first connection terminal, whereby the contact reliability increases.

In a different embodiment according to the present invention, the first movable contact of the first connection terminal and the second movable contact of the second connection terminal may be alternately shifted in the inserting direction to be arranged in a staggered manner.

According to such an embodiment, the first and second joints can be arranged at a higher mounting density, and the connector can be miniaturized.

When the FPC is connected to the connector according to the present invention, the tip portion of the FPC having the first and second joints juxtaposed will have a wave-like shape in the width direction and in the inserting direction. Thus, a connector in which the FPC is less likely to come off, has strong resistance to being pulled around, and has high contact reliability is obtained.

DESCRIPTION OF SYMBOLS

Figure 1A:
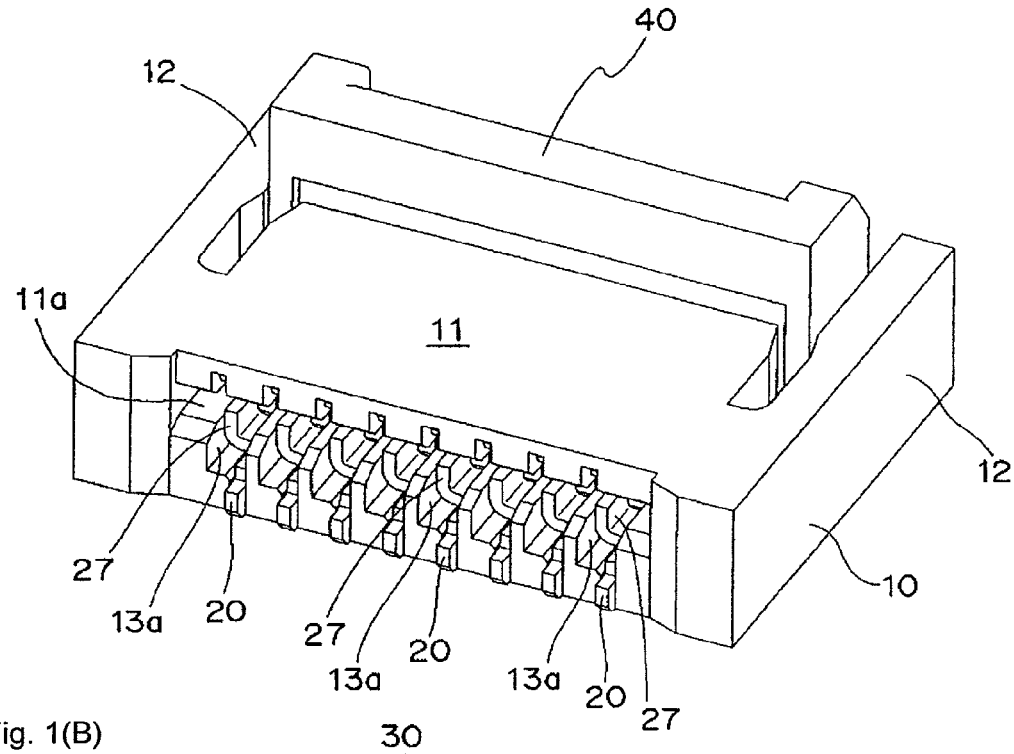
FIGS. 1A and 1B are perspective views showing before and after the operation of a connector according to the present invention.

10: Connector
11: Base
11*a*: Opening
12: Elastic arm
13: First insertion hole
13*a*: Fit-in step
14: Second insertion hole
15: Guide plate
15*a*: Guide groove
20: First connection terminal
22: Operating piece
23: First movable contact
24: Operation receiving portion
27: Pressure-contact tongue piece
30: Second connection terminal
32: Operating piece
33: Second movable contact
34: Operation receiving portion
37: Turning recessed portion
40: Operating lever
41: Turning shaft portion
42: First operating portion
43: Second operating portion
44: Through-hole
50: FPC
51: Tip portion
52: First joint
53: Second joint

BEST MODE FOR CARRYING OUT THE INVENTION

An embodiment according to the present invention will be described with reference to the accompanying drawings FIGS. 1 to 14.

Figure 1B:
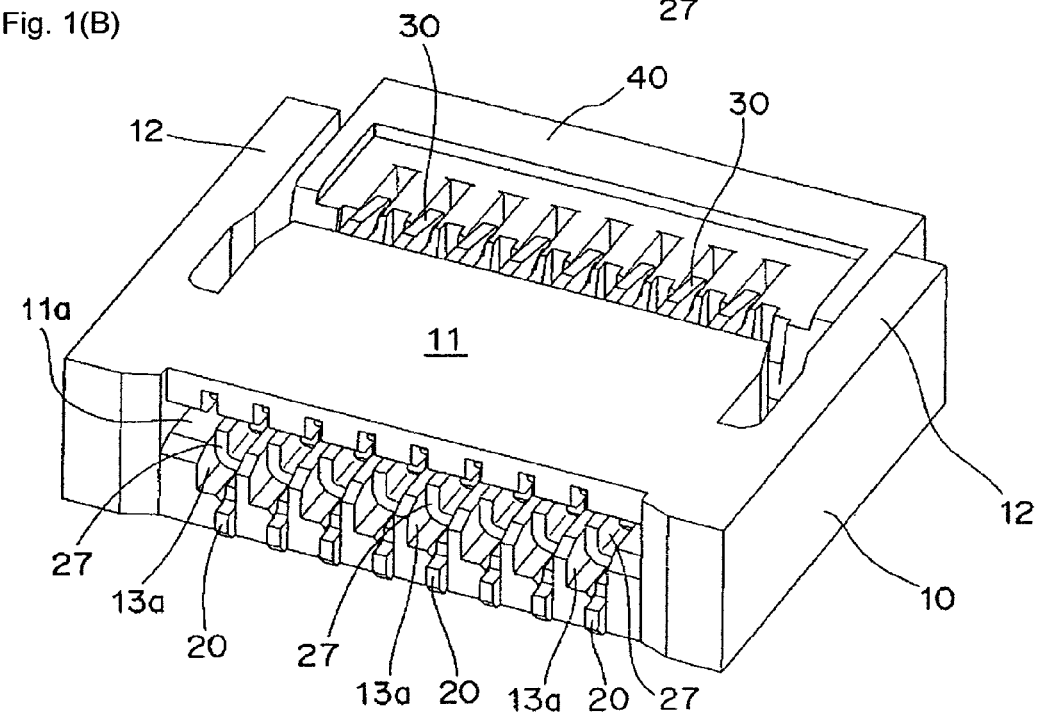
Figure 2:
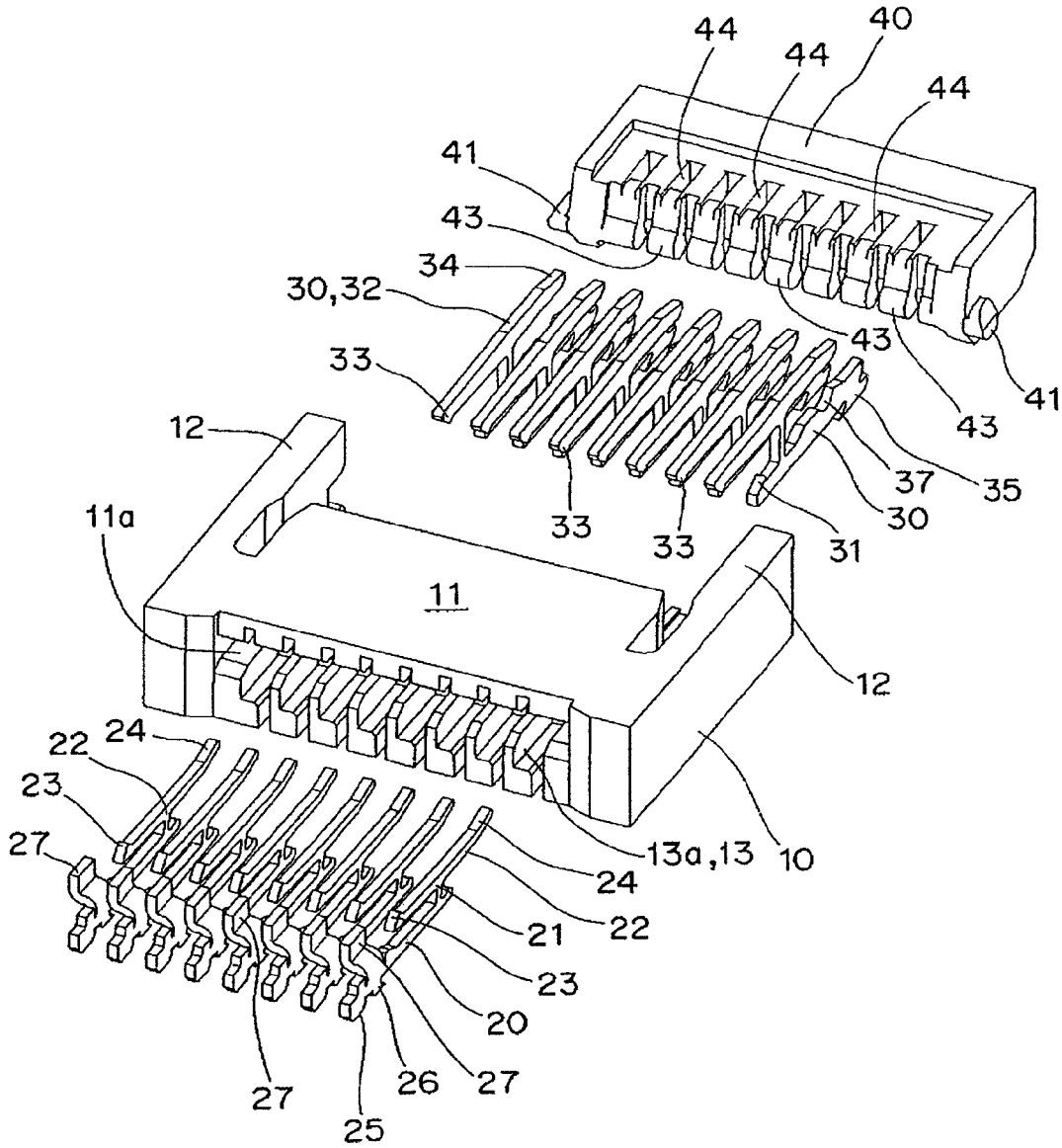
FIG. 2 is an exploded perspective view of the connector shown in FIG. 1B.
Figure 3:
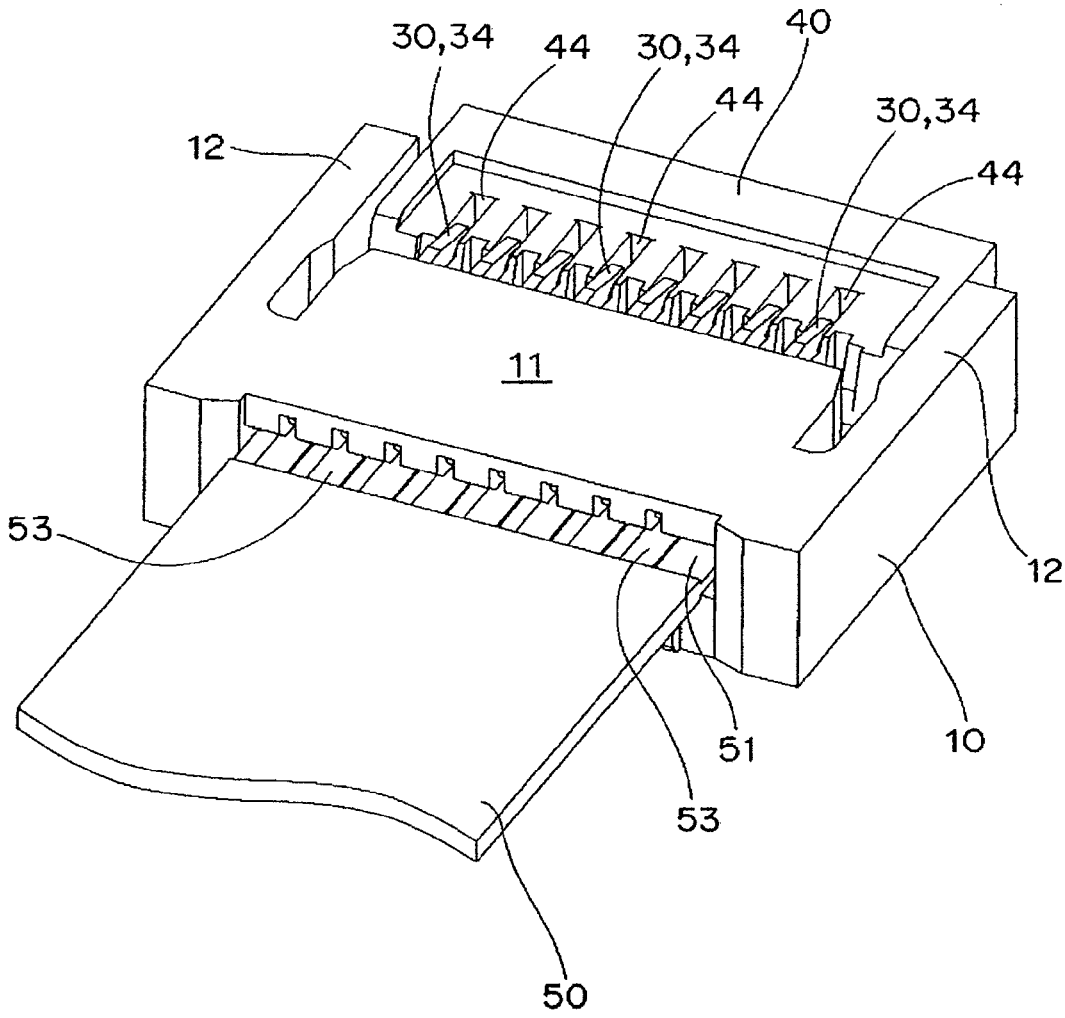
FIG. 3 is a perspective view showing a case of connecting a flexible printed circuit board to the connector shown in FIG. 1.

As shown in FIGS. 1 to 3, a connector 10 according to a first embodiment is broadly made up of a base 11, a first connection terminal 20, a second connection terminal 30, and an operating lever 40.

Figure 5A:
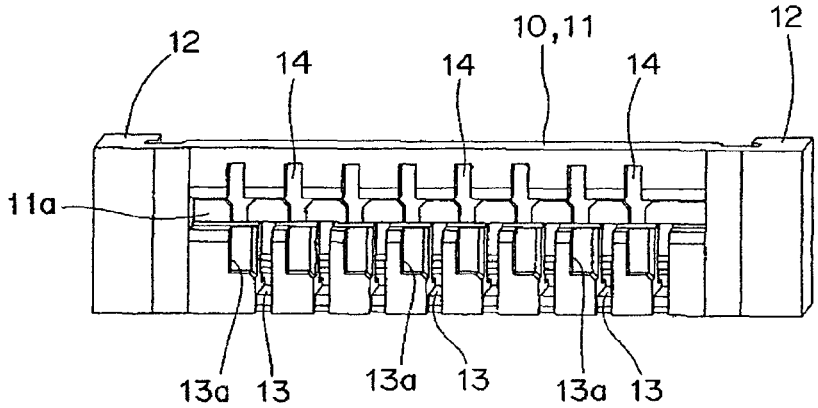
FIGS. 5A, 5B, and 5C are a front view of a base, a perspective view seen from the rear surface side, and a cross-sectional view taken along line C-C of FIG. 5B, respectively.
Figure 5B:
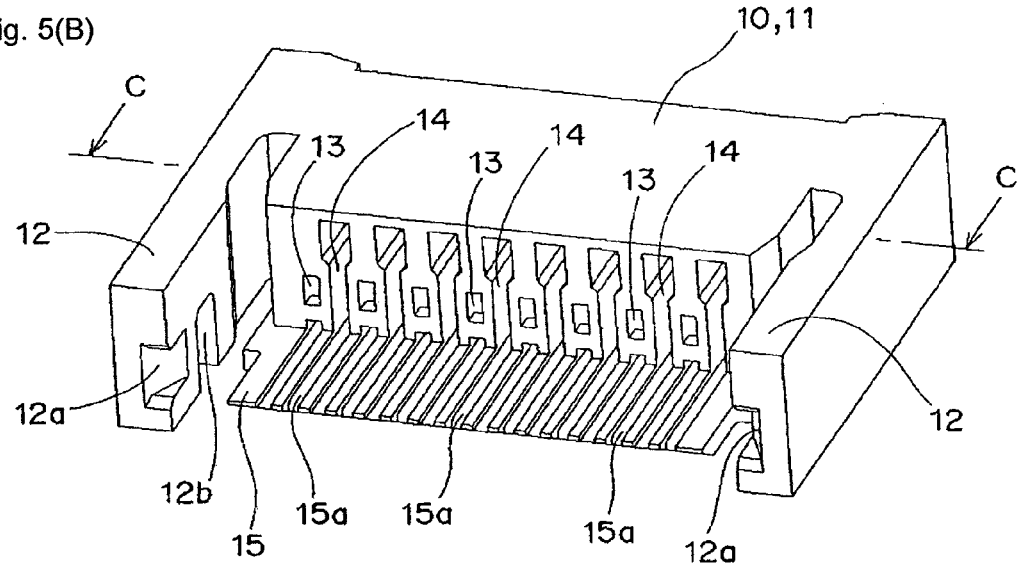
Figure 5C:
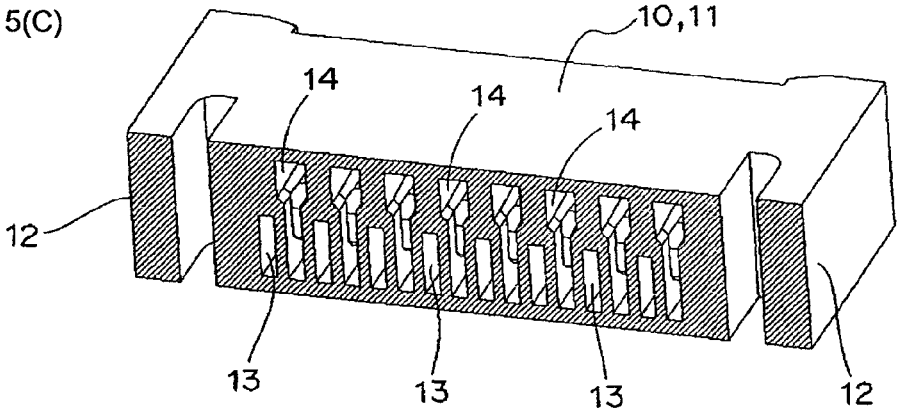

As shown in FIG. 5B, the base 11 has elastic arms 12, 12 extending in parallel on the rear surface side from an edge on one side at both side end faces of the base 11. A guide tapered surface 12*a* is formed at the distal end edge of the inward surface of the elastic arm 12, and a bearing slit 12*b* is formed on the far side thereof. As shown in FIG. 5A, the base 11 includes an opening 11*a* to which a tip portion 51 of an FPC 50, to be hereinafter described, can be inserted at the front surface, and has a first insertion hole 13 with a fit-in step 13*a* juxtaposed at a predetermined pitch. As shown in FIG. 5B, a second insertion hole 14 is juxtaposed so as to be positioned between the first insertion holes 13 on the rear surface side of the base 11. The base 11 also has a guide plate 15 extending between the elastic arms 12, 12 from the edge on the lower side of the rear surface. A guide groove 15*a* communicating to the second insertion hole 14 formed on the base 11 is juxtaposed at a predetermined pitch on the upper surface of the guide plate 15. As shown in FIG. 5C, the first insertion hole 13 and the second insertion hole 14 are shifted in the up and down direction, and thus a core pin of a molding die (not shown) can be formed thick to thereby easily ensure a predetermined strength.

Figure 6A:
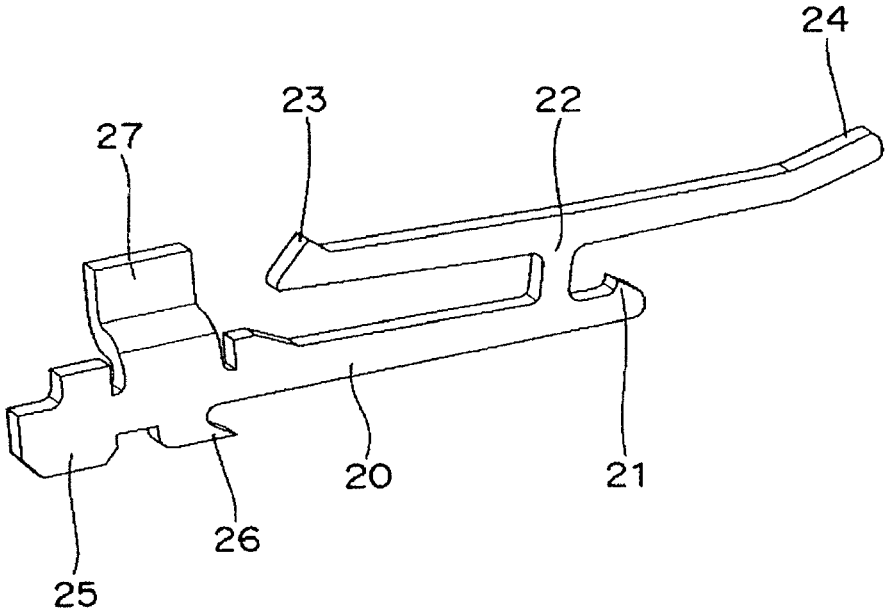
FIGS. 6A and 6B are perspective views showing a first connection terminal and a second connection terminal.

As shown in FIG. 6A, the first connection terminal 20 has a slip-out preventing projecting 21 formed at one end to be inserted to the first insertion hole 13 of the base 11, where a substantially T-shaped operating piece 22 is arranged in a projecting manner near the slip-out preventing projection 21. One end of the operating piece 22 has a first movable contact 23 projecting upward, and the other end acts as an operation receiving portion 24. The first connection terminal 20 is formed with a terminal portion 25 and a locking nail portion 26 at the lower edge on the other end side, and has a pressure-contact tongue piece 27 risen at the upper edge.

Figure 6B:
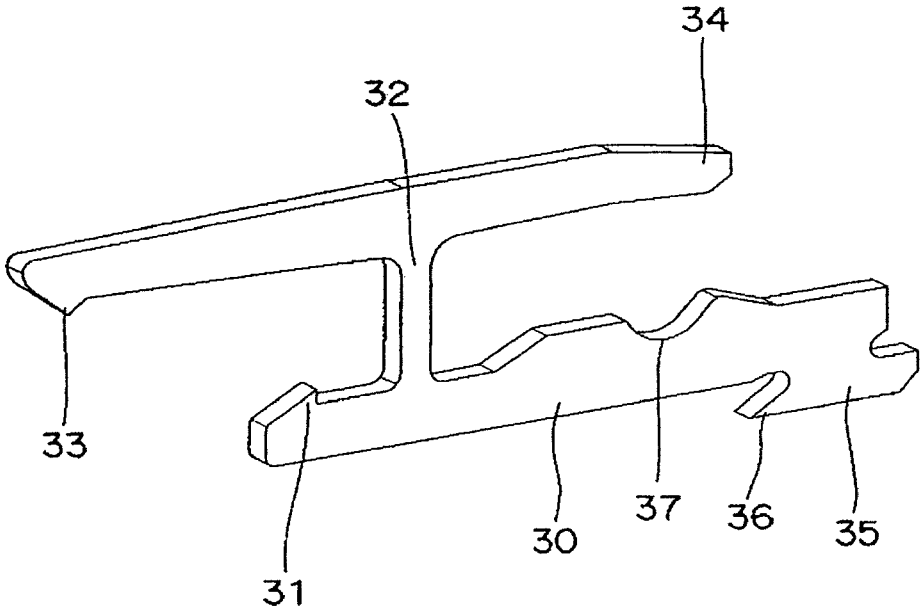

As shown in FIG. 6B, the second connection terminal 30 has a slip-out preventing projecting 31 formed at one end to be inserted to the second insertion hole 14 of the base 11, where a substantially T-shaped operating piece 32 is arranged in a projecting manner near the slip-out preventing projection 31. One end of the operating piece 32 has a first movable contact 33 projecting downward, and the other end acts as an operation receiving portion 34. The second connection terminal 30 is formed with a terminal portion 35 and a locking nail portion 36 at the lower edge on the other end side, and has a turning recessed portion 37 formed at the upper edge.

Figure 7A:
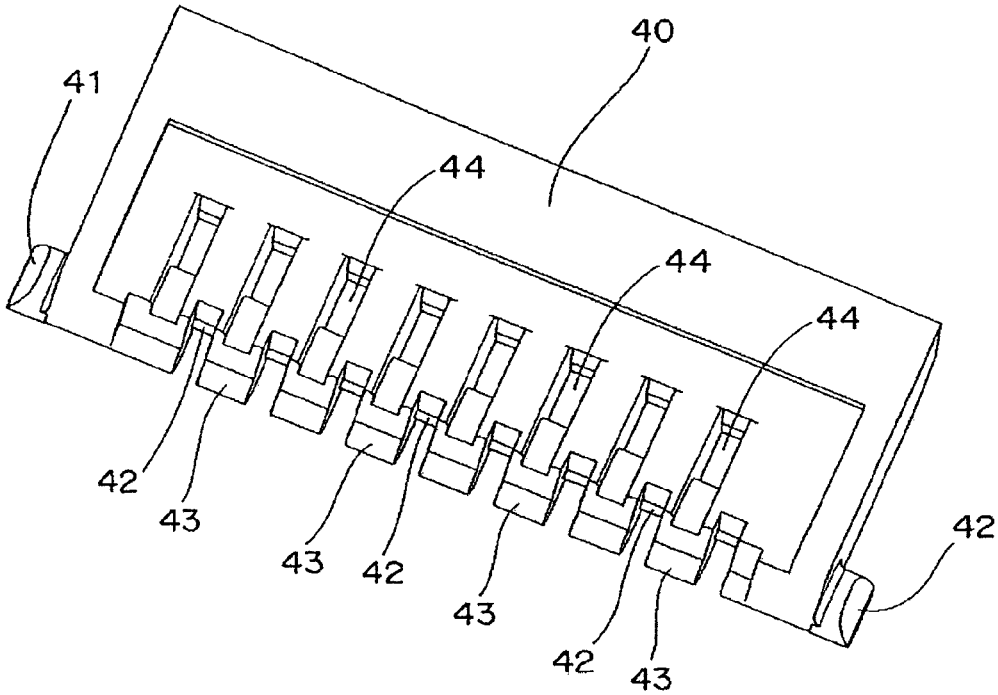
FIGS. 7A and 7B are perspective views of an operating lever seen from different angles.
Figure 7B:
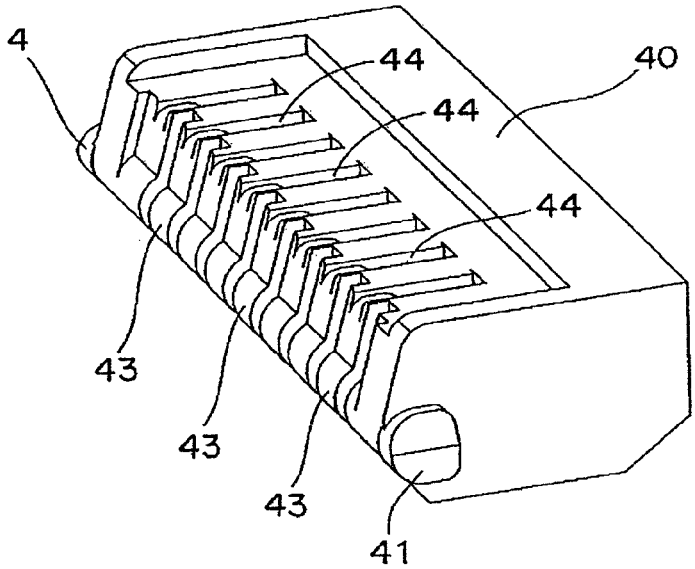
Figure 8A:
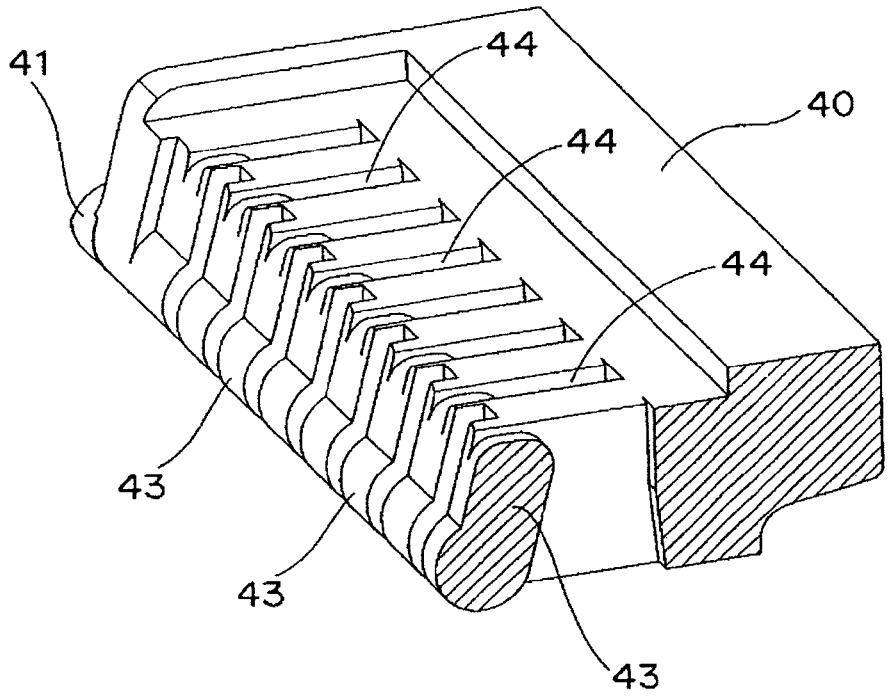
FIGS. 8A and 8B are cross-sectional perspective views at different positions of the operating lever shown in FIG. 7.
Figure 8B:
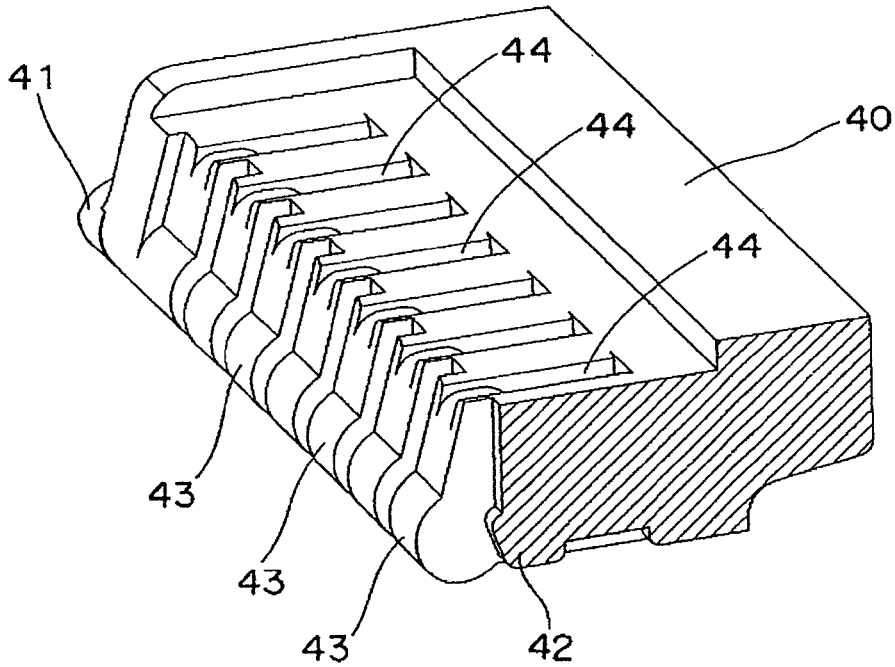

As shown in FIGS. 7 and 8, the operating lever 40 has turning shaft portions 41, 41 arranged in a projecting manner on the same axis center at both side end faces. The operating lever 40 also has a first operating portion 42 for operating the first connection terminal 20 juxtaposed at a predetermined pitch at the edge on one side, and a second operating portion 43 for operating the second connection terminal 30 arranged between the first operating portions 42, so that the first operating portion 42 and the second operating portion 43 are alternately arranged. A through-hole 44 through which the operation receiving portion 34 of the second connection terminal 30 passes is formed behind the second operating portion 43.

Figure 4A:
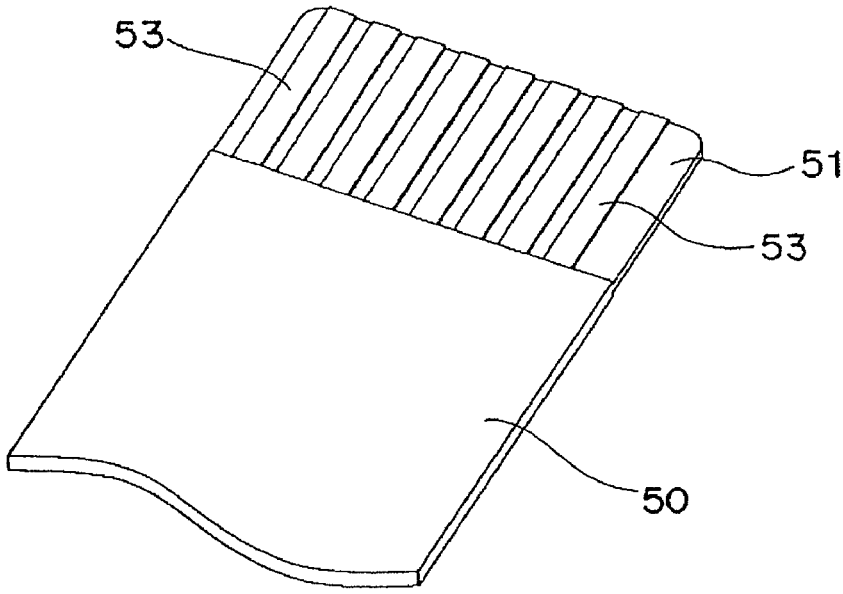
FIGS. 4A and 4B are partial perspective views showing front and back surfaces of the flexible printed circuit board shown in FIG. 3.
Figure 4B:
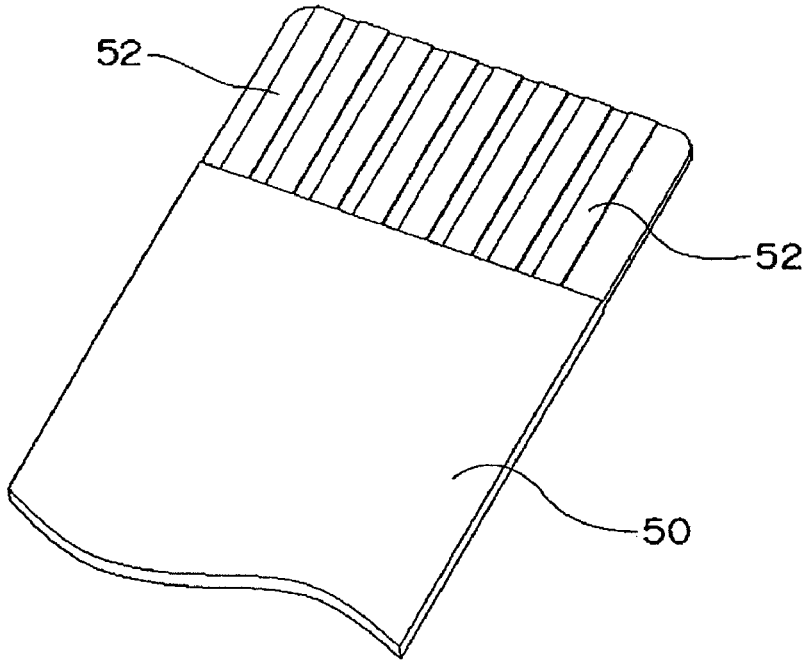

As shown in FIG. 4, the FPC 50 connected to the connector 10 according to the present embodiment has second and first joints 53, 52 print wired on the upper and lower surfaces of the tip portion 51 juxtaposed at a predetermined pitch. In particular, the first joint 52 formed on the lower surface and the second joint 53 formed on the upper surface are alternately arranged in a staggered manner so as not to overlap.

A method for assembling the components described above will now be described.

Figure 10A:
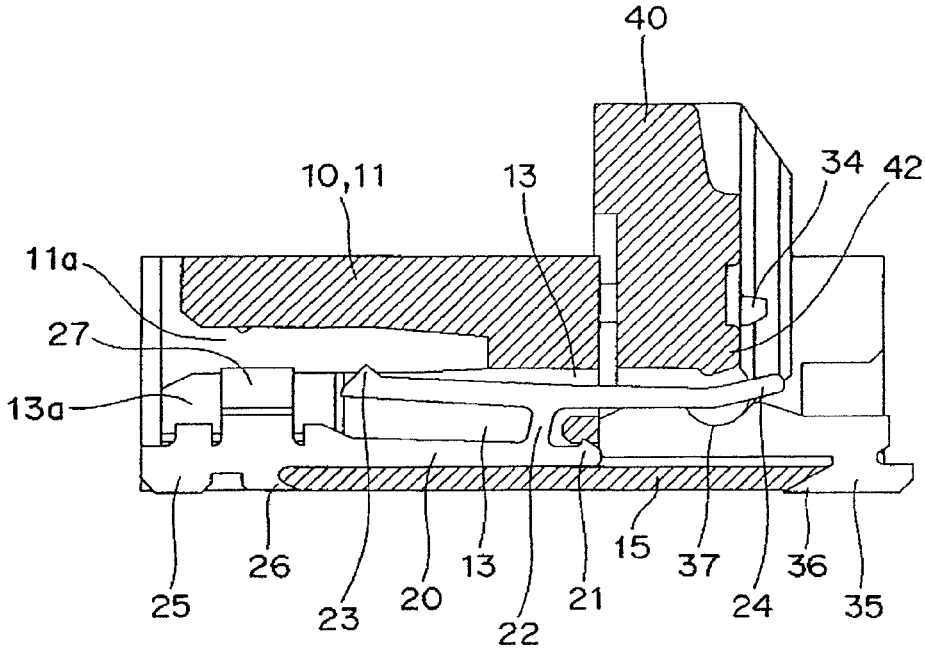
FIGS. 10A and 10B are cross-sectional views at different positions showing before the operation of the connector.

First, when the first connection terminal 20 is inserted to the first insertion hole 13 from the front surface side of the base 11, the slip-out preventing projection 21 arranged at the tip portion of the first connection terminal 20 locks to the base 11, and the locking nail portion 26 locks to the edge of the base 11 to be positioned (FIG. 10A). The pressure-contact tongue piece 27 is fitted into the fit-in step 13*a* of the base 11.

Figure 10B:
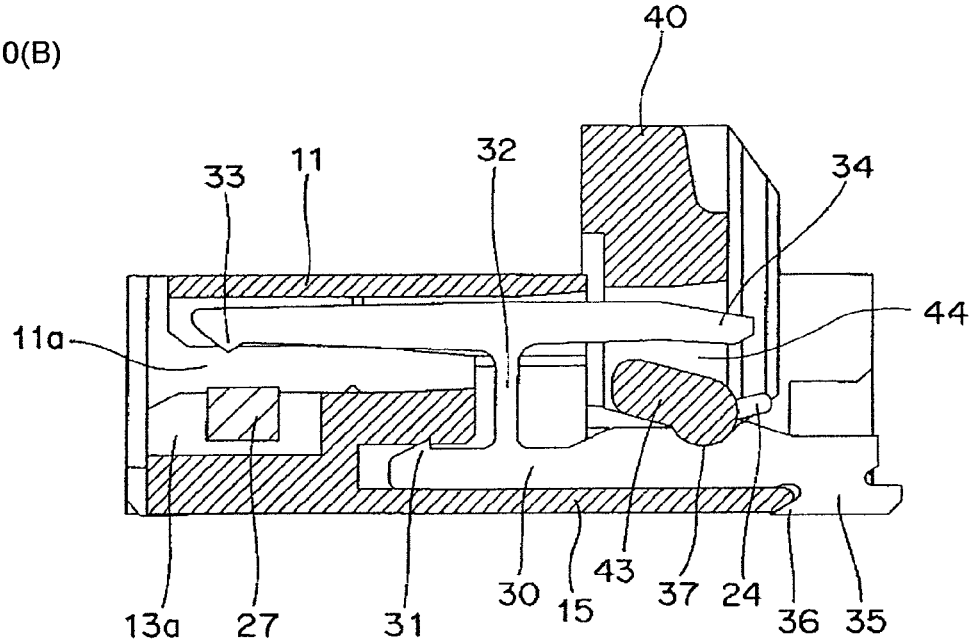
Figure 11:
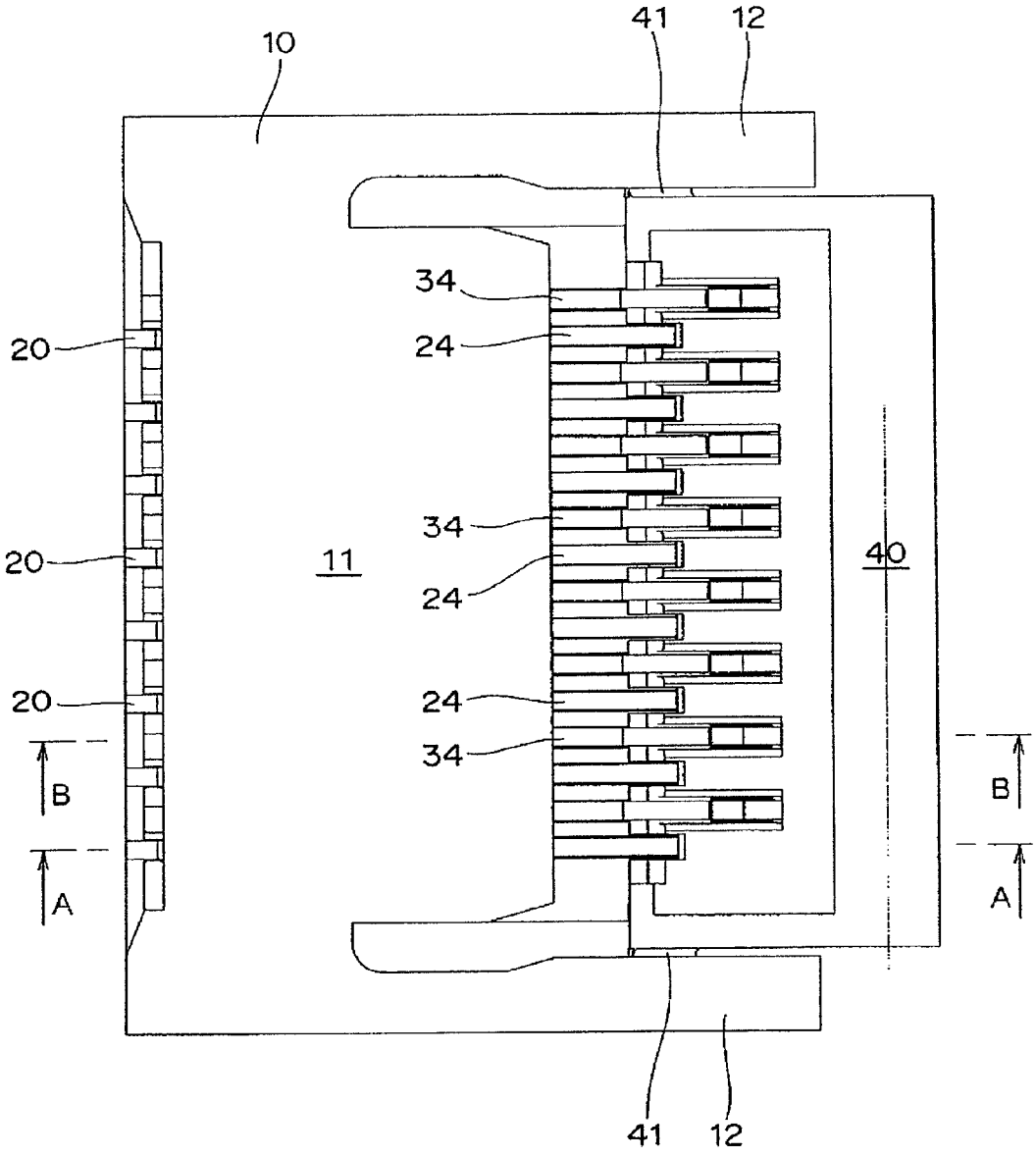
FIG. 11 is a plan view showing after the operation of the connector.

The second connection terminal 30 is sled along the guide groove 15*a* formed in the guide plate 15 of the base 11 to insert the second connection terminal 30 to the second insertion hole 14, whereby the slip-out preventing projection 31 arranged at the tip portion of the second connection terminal 30 locks to the base 11 and the locking nail portion 36 locks to the edge of the base 11 to be positioned (FIG. 10B). In this case, the movable contact 33 of the second connection terminal 30 is positioned immediately above the pressure-contact tongue piece 27 of the first connection terminal 20.

The operation receiving portion 34 of the second connection terminal 30 is then inserted and assembled to a relief hole 44 of the operating lever 40, the operation receiving portion 34 is pushed up and assembled in an elastically deformed state by the second operating portion 43, and the second operating portion 43 is positioned in the turning recessed portion 37 of the second connection terminal 30 (FIG. 10B).

A case of connecting and fixing the FPC will be described based on FIGS. 9 to 12.

Figure 9:
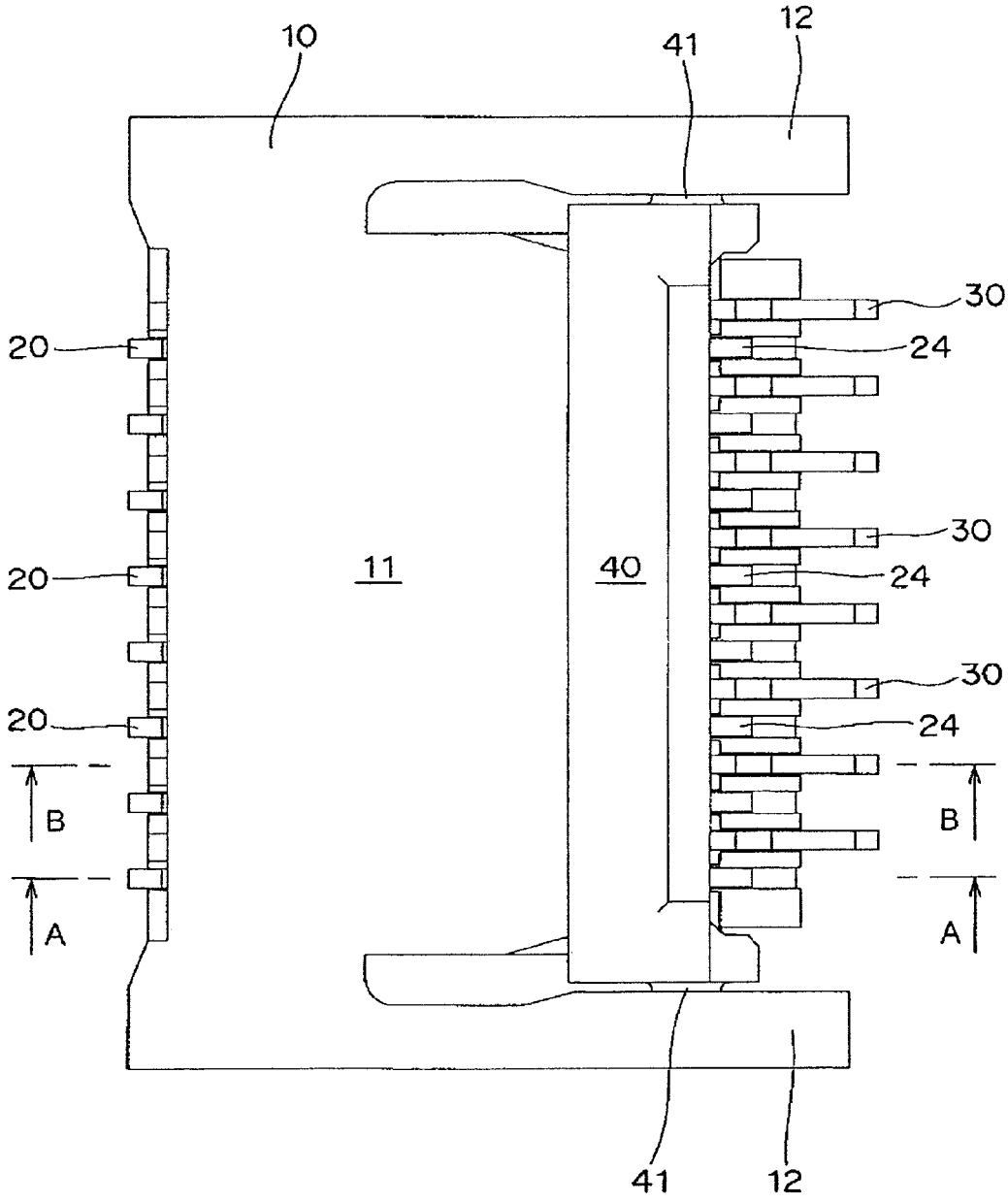
FIG. 9 is a plan view showing before the operation of the connector.
Figure 12A:
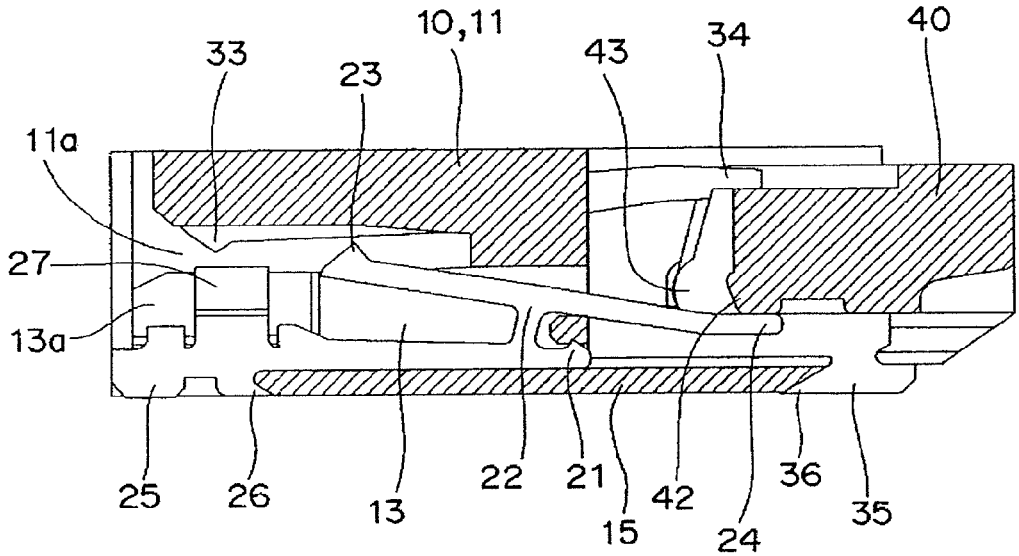
FIGS. 12A and 12B are cross-sectional views at different positions showing after the operation of the connector.
Figure 12B:
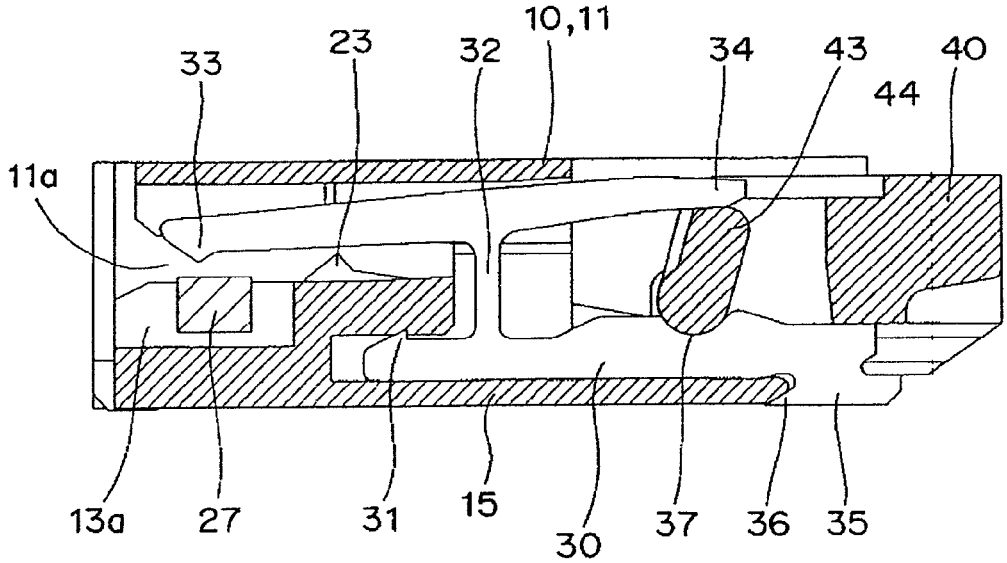

The tip portion 51 of the FPC 50 shown in FIG. 4 is inserted to the opening 11*a* of the base 11 in the state shown in FIGS. 9 and 10 until hitting the inner side surface of the base 11. The operating lever 40 is then pushed down with the axis center of the turning shaft portion 41 as the center (FIGS. 11 and 12), so that the first operating portion 42 pushes down the operation receiving portion 24 of the first connection terminal 20, as shown in FIG. 12A. Thus, the substantially T-shaped operating piece 22 tilts, and the first movable contact 23 pushes up the lower surface of the tip portion 51 of the FPC 50 (not shown) and pushes it against the roof surface of the base 11 to conduct to the first joint 52 of the FPC 50.

At the same time, the second operating portion 43 of the operating lever 40 is turned in the turning recessed portion 37 of the second connection terminal 30 to push up the operation receiving portion 34 of the second connection terminal 30. Thus, the substantially T-shaped contacting piece 32 tilts, and the second movable contact 33 pushes the upper surface of the tip portion 51 of the FPC 50 against the pressure-contact tongue piece 27 of the first connection terminal 20 to conduct to the second joint 53 of the FPC 50.

Figure 13A:
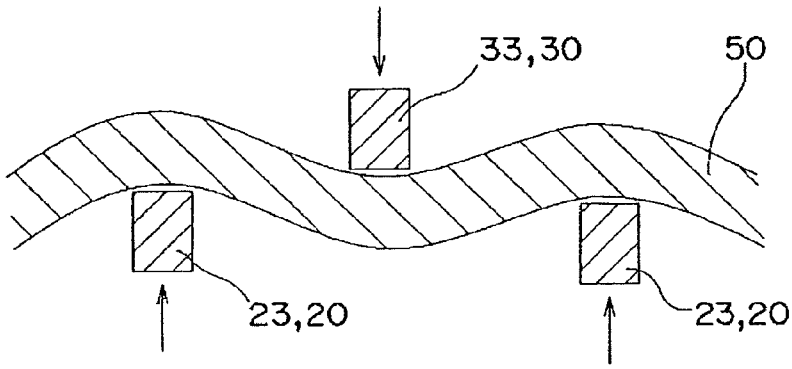
FIGS. 13A and 13B are a schematic cross-sectional view and a schematic plan view, respectively, of the FPC for describing an attached state.
Figure 13B:
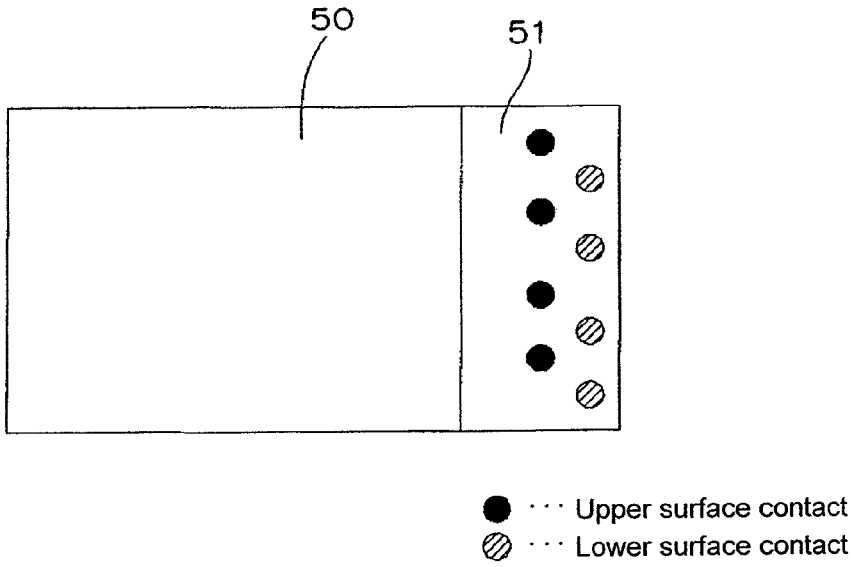

As shown in FIG. 13, according to the present embodiment, the first movable contact 23 and the second movable contact 33 are arranged in a staggered manner in an up and down direction, and in a front and back direction. Thus, the tip portion 51 of the FPC 50 has a wave-like shape to the left and right and front and back, and thus it is less likely to come off, has strong resistance to being pulling around, and has higher contact reliability.

Figure 14:
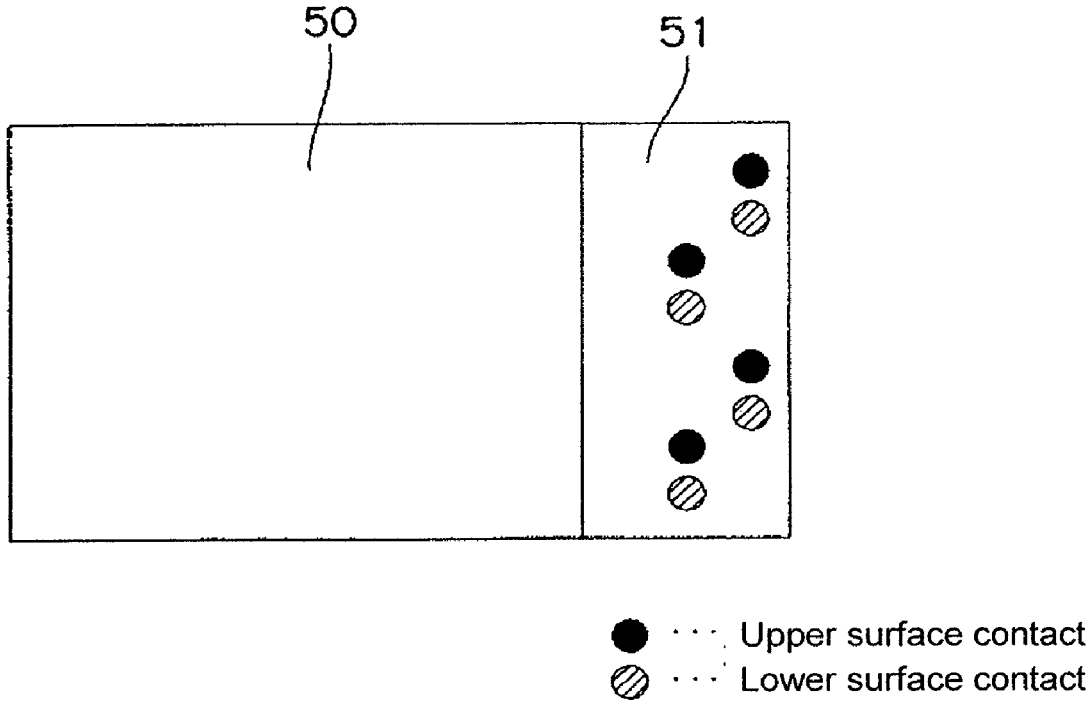
FIG. 14 is a schematic plan view of the FPC for describing the attached state of a second embodiment according to the present invention.

Moreover, as shown in FIG. 14, the adjacent first movable contacts 23, 23 of the first connection terminal 20 may be arranged in a staggered manner in the front and back direction, and the adjacent second movable contacts 33, 33 of the second connection terminal 30 may be arranged in a staggered manner in the front and back direction (second embodiment).

According to the present embodiment, the mounting density is higher, the miniaturization is easily achieved, and the contact reliability increases.

INDUSTRIAL APPLICABILITY

The connector according to the present invention is not limited to the connector described above, and may, obviously, be applied to other connectors.

The invention claimed is:

1. A connector comprising:

a base having an opening to be inserted with a tip portion of a flexible printed circuit board at a front surface, and having a first insertion hole and a second insertion hole alternately juxtaposed at a predetermined pitch at the front surface and a rear surface, respectively;

a first connection terminal to be inserted to the first insertion hole from a side, and having a first movable contact that comes into pressure contact with a first joint juxtaposed at a lower surface of the tip portion of the flexible printed circuit board;

a second connection terminal to be inserted to the second insertion hole from a side, and having a second movable contact that comes into pressure contact with a second joint juxtaposed at an upper surface of the tip portion of the flexible printed circuit board; and an operating lever turnably supported by a pair of elastic arms extending in parallel from both side surfaces of the base, and having a first operating portion and a second operating portion for operating the first connection terminal and the second connection terminal, respectively, alternately juxtaposed at an edge on one side, wherein the first operating portion and second operating portion are a different shape.

2. The connector according to claim 1, wherein the first movable contact of the first connection terminal and the second movable contact of the second connection terminal are alternately shifted in the inserting direction to be arranged in a staggered manner.

3. The connector according to claim 1, wherein movable contacts adjacent on the same plane are alternately shifted in an inserting direction to be arranged in a staggered manner.

4. The connector according to claim 3, wherein a pressure-contact tongue piece that is positioned immediately below the second movable contact of the second connection terminal and that comes into pressure contact with a lower surface of the second joint of the flexible printed circuit board is arranged in a projecting manner at the first connection terminal.

5. The connector according to claim 3, wherein the first movable contact of the first connection terminal and the second movable contact of the second connection terminal are alternately shifted in the inserting direction to be arranged in a staggered manner.

6. The connector according to claim 1, wherein the first insertion hole and the second insertion hole are alternately shifted in an up and down direction to be arranged in a staggered manner.

7. The connector according to claim 6, wherein movable contacts adjacent on the same plane are alternately shifted in an inserting direction to be arranged in a staggered manner.

8. The connector according to claim 6, wherein a pressure-contact tongue piece that is positioned immediately below the second movable contact of the second connection terminal and that comes into pressure contact with a lower surface of the second joint of the flexible printed circuit board is arranged in a projecting manner at the first connection terminal.

9. The connector according to claim 6, wherein the first movable contact of the first connection terminal and the second movable contact of the second connection terminal are alternately shifted in the inserting direction to be arranged in a staggered manner.

10. The connector according to claim 1, wherein a pressure-contact tongue piece that is positioned immediately below the second movable contact of the second connection terminal and that comes into pressure contact with a lower surface of the second joint of the flexible printed circuit board is arranged in a projecting manner at the first connection terminal.

11. The connector according to claim 10, wherein the first movable contact of the first connection terminal and the second movable contact of the second connection terminal are alternately shifted in the inserting direction to be arranged in a staggered manner.

12. A connector comprising:

a base having an opening to be inserted with a tip portion of a flexible printed circuit board at a front surface, and having a first insertion hole and a second insertion hole alternately juxtaposed at a predetermined pitch at the front surface and a rear surface, respectively;

a first connection terminal to be inserted to the first insertion hole from a side, and having a first movable contact that comes into pressure contact with a first joint juxtaposed at a lower surface of the tip portion of the flexible printed circuit board;

a second connection terminal to be inserted to the second insertion hole from a side, and having a second movable contact that comes into pressure contact with a second joint juxtaposed at an upper surface of the tip portion of the flexible printed circuit board; and an operating lever turnably supported by a pair of elastic arms extending in parallel from both side surfaces of the base, and having a first operating portion and a second operating portion for operating the first connection terminal and the second connection terminal, respectively, alternately juxtaposed at an edge on one side, and wherein the first insertion hole and the second insertion hole are alternately shifted in an up and down direction to be arranged in a staggered manner.

13. The connector according to claim 12, wherein movable contacts adjacent on the same plane are alternately shifted in an inserting direction to be arranged in a staggered manner.

14. The connector according to claim 12, wherein a pressure-contact tongue piece that is positioned immediately below the second movable contact of the second connection terminal and that comes into pressure contact with a lower surface of the second joint of the flexible printed circuit board is arranged in a projecting manner at the first connection terminal.

15. The connector according to claim 12, wherein the first movable contact of the first connection terminal and the second movable contact of the second connection terminal are alternately shifted in the inserting direction to be arranged in a staggered manner.

16. A connector comprising:

a base having an opening to be inserted with a tip portion of a flexible printed circuit board at a front surface, and having a first insertion hole and a second insertion hole alternately juxtaposed at a predetermined pitch at the front surface and a rear surface, respectively;

a first connection terminal to be inserted to the first insertion hole from a side, and having a first movable contact that comes into pressure contact with a first joint juxtaposed at a lower surface of the tip portion of the flexible printed circuit board;

a second connection terminal to be inserted to the second insertion hole from a side, and having a second movable contact that comes into pressure contact with a second joint juxtaposed at an upper surface of the tip portion of the flexible printed circuit board; and an operating lever turnably supported by a pair of elastic arms extending in parallel from both side surfaces of the base, and having a first operating portion and a second operating portion for operating the first connection terminal and the second connection terminal, respectively, alternately juxtaposed at an edge on one side, and wherein a pressure-contact tongue piece that is positioned immediately below the second movable contact of the second connection terminal and that comes into pressure contact with a lower surface of the second joint of the flexible printed circuit board is arranged in a projecting manner at the first connection terminal.

17. The connector according to claim 16, wherein the first movable contact of the first connection terminal and the second movable contact of the second connection terminal are alternately shifted in the inserting direction to be arranged in a staggered manner.

* * * * *